US008795002B2

(12) United States Patent
Gregori et al.

(10) Patent No.: US 8,795,002 B2
(45) Date of Patent: Aug. 5, 2014

(54) CO-EDGE CONNECTOR

(75) Inventors: Timothy R. Gregori, Lockport, IL (US); Joseph D. Comerci, Elmhurst, IL (US); Kevin O'Connor, Lisle, IL (US); Herbert Endres, Munich (DE); Mikael Sigfridsson, Stockholm (SE)

(73) Assignee: Molex Incorporated, Lisle, IL (US)

( * ) Notice: Subject to any disclaimer, the term of this patent is extended or adjusted under 35 U.S.C. 154(b) by 143 days.

(21) Appl. No.: 13/201,719

(22) PCT Filed: Feb. 15, 2010

(86) PCT No.: PCT/US2010/024232
§ 371 (c)(1),
(2), (4) Date: Oct. 25, 2011

(87) PCT Pub. No.: WO2010/094007
PCT Pub. Date: Aug. 19, 2010

(65) Prior Publication Data

US 2012/0040565 A1 Feb. 16, 2012

Related U.S. Application Data

(60) Provisional application No. 61/152,929, filed on Feb. 16, 2009.

(51) Int. Cl.
*H01R 24/00* (2011.01)
*H01R 12/16* (2006.01)

(52) U.S. Cl.
CPC ..... *H01R 23/7073* (2013.01); *H01R 23/02* (2013.01); *H01R 23/725* (2013.01)
USPC ..... 439/660

(58) Field of Classification Search
CPC .. H01R 23/7073; H01R 23/02; H01R 23/725; H01R 13/658; H01R 23/668
USPC ..... 439/660, 61, 65, 495
See application file for complete search history.

(56) References Cited

U.S. PATENT DOCUMENTS 3,895,266 A 7/1975 Geiger
4,216,523 A 8/1980 Harford
(Continued)

FOREIGN PATENT DOCUMENTS

CN 101267217 A 9/2008
JP 2001-297843 10/2001
WO WO 2008/023006 A1 2/2008

OTHER PUBLICATIONS

International Search Report for PCT/US2010/024232.

*Primary Examiner* — Amy Cohen Johnson
*Assistant Examiner* — Vladimir Imas
(74) *Attorney, Agent, or Firm* — Stephen L. Sheldon

(57) ABSTRACT

A co-edge connector (200) is provided that includes a housing (200*a*) that supports a plurality of terminals (210). One side of the housing includes a slot (230) that is configured to accept a panel (30) and first terminal contacts (213) are positioned in the slot. An exposed support surface (206) extends from a wall (204) on a second side and second terminal contacts (211) extend above the support surface. In operation, if the panel inserted into the slot is inserted in a vertical direction, the second contacts can engage pads of panel where the panel is mounted on the housing by moving the panel in a vertical direction.

12 Claims, 6 Drawing Sheets

(56) References Cited

U.S. PATENT DOCUMENTS

| | | | | |
|---|---|---|---|---|
| 4,462,657 | A * | 7/1984 | Snowdon et al. | 439/840 |
| 4,969,842 | A | 11/1990 | Davis | |
| 4,981,449 | A * | 1/1991 | Buchter | 439/724 |
| 5,295,852 | A * | 3/1994 | Renn et al. | 439/328 |
| 5,531,615 | A | 7/1996 | Irlbeck et al. | |
| 5,655,922 | A * | 8/1997 | Dux et al. | 439/213 |
| 6,238,237 | B1 | 5/2001 | Nagahata et al. | |
| 6,541,756 | B2 * | 4/2003 | Schulz et al. | 250/221 |
| 6,579,125 | B1 | 6/2003 | Nagahata et al. | |
| 6,672,905 | B2 * | 1/2004 | Tharp et al. | 439/660 |
| 6,722,920 | B2 * | 4/2004 | Zhang | 439/571 |
| 6,790,055 | B1 | 9/2004 | Shiu et al. | |
| 7,204,719 | B2 * | 4/2007 | Kikuchi | 439/631 |
| 7,416,452 | B1 * | 8/2008 | Sabo | 439/631 |
| 7,547,214 | B2 * | 6/2009 | Duesterhoeft et al. | 439/61 |
| 7,845,985 | B2 * | 12/2010 | Brunker et al. | 439/631 |
| 2002/0132529 | A1 * | 9/2002 | Tharp et al. | 439/660 |
| 2003/0139093 | A1 * | 7/2003 | Zhang | 439/571 |
| 2008/0293262 | A1 * | 11/2008 | Duesterhoeft et al. | 439/65 |
| 2012/0040565 | A1 | 2/2012 | Gregori et al. | |

* cited by examiner

CO-EDGE CONNECTOR

This application claims priority to U.S. Provisional Application Ser. No. 61/152,929, filed Feb. 16, 2009, which is incorporated herein by referenced in its entirety.

BACKGROUND OF THE INVENTION

1. Field of the Invention

The present invention relates to the field of connectors, more specifically to a connector suitable for coupling to an edge of a panel.

2. Description of Related Art

Co-edge connectors are known and have been used to couple two edges of a board together. Existing designs, however, have been unsuitable to address certain architectural needs. For example, as depicted in FIG. 1, when coupling two panels together a co-edge connector 100 can include opposing slots to receive panels 20 and 30. Two panels will be provided with traces provided on a first side and each slot will include a plurality of terminals configured to engage the traces. Thus, the first panel 20 is inserted in the first slot and then the second panel 30 is inserted into the opposing second slot so that the terminals (not shown) couples traces on the first panel to traces on the second panel. As can be appreciated, each panel has a width 15, 16 and the connector 100 can be configured to couple two panels of different widths. Once inserted into the slot, a fastener may be used to couple the panels to the co-edge connector. More regarding such a connector is disclosed in U.S. patent application Ser. No. 12/328,577, filed Dec. 4, 2008, which is incorporated herein by reference in its entirety.

The advantage of the configuration depicted in FIG. 1 is the ability to mate two panels together without the need to solder the terminals to the panel while still providing high data rates. One potential issues, however, is that for situations where there is limited space it can be difficult to provide a slot that can ensure reliable connector between the terminals and the traces while allowing sufficient space to allow the second panel to be inserted into the slot. This is because at a minimum sufficient space is needed to allow the edge of the panel to be aligned with the slot before being inserted therein. Furthermore, if there are components mounted on a second side of the panel near the edge, then it is typically not possible to slide the second panel into the second slot. Therefore, improvements to a co-edge connector would be appreciated by certain individuals.

BRIEF SUMMARY OF THE INVENTION

In an embodiment, a co-edge connector is provided with terminals mounted to a side. The co-edge connector includes fastener locations on opposing sides and terminals extending between a first side and a second side. The first side of the co-edge connector engages a first panel so that terminals on the first side engage traces on the first panel and a fastener may be used to secure the first side to the first panel. In an embodiment, the first panel may be inserted into a slot in the co-edge connector. The terminals extend toward the second side and are exposed so that the co-edge connector may be positioned directly on traces on a second panel with the panel. The co-edge connector and the second panel may be configured to be moved toward each other in a direction that is perpendicular to a plane formed by the traces on the second panel.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1:
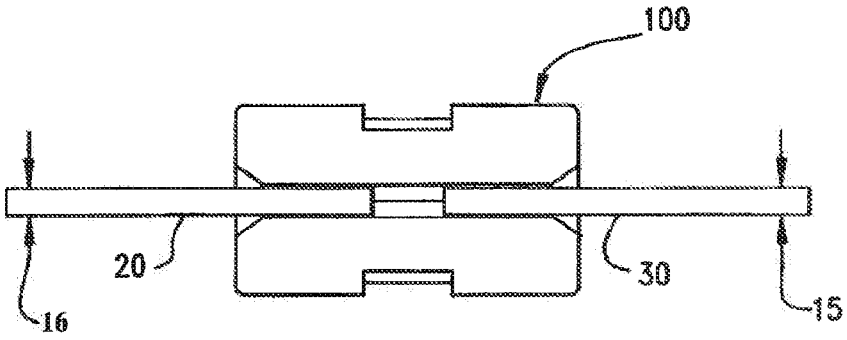
FIG. 1 (Prior Art)
FIG. 1 illustrates an elevated side cross-section schematic view of an embodiment of a co-edge connector.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

FIGS. 2-5 illustrate an embodiment of a co-edge connector 200 that can be configured to provide high data rates while offering a flexible installation configuration. A co-edge connector 200 includes a housing **200*a*, which can be formed of an insulating material, and the housing 200*a* includes a slot 230 configured to receive a first panel 30, which could be a circuit board or card edge or other similar shaped structure, and terminals 210 in the co-edge connector 200 couple to edge traces on an edge 30 of the first panel 30. A fastener 225, such as a screw or a rivet, may be used to secure the co-edge connector to the first panel. In an alternative embodiment, the co-edge connector 200** may include an integrated retaining feature configured to engage a corresponding feature on the first panel (such as a notch and rib or the like). For example, without limitation, the co-edge connector may include a deflectable member that is moved from a first position to a second position as the first panel is inserted into the slot and once the first panel is fully inserted into the slot, the deflectable member translates back to the first position and in the process engages a retaining feature, such as an aperture or detent, in the first panel so that the first panel is retained in the slot.

The housing 200*a* is configured so that the terminals 210 extend from the slot (where they are configured to engage traces on an inserted panel) to an exposed position on a support surface 206 that extends from a wall 204. It should be noted that while the support surface 206 and wall 204 could be substantially planar, if desired the support surface 206 could be formed by two surfaces or more that are configured to support the panel but is not continuous. In addition, the wall 204 could be angled and also need not be continuous. In an embodiment, a portion of the exposed terminals 210, such as contact 213, may be positioned adjacent (or partially positioned in) individual channels on one side of the housing 200*a* while the other side of the terminal (contact 211) is exposed and free to be pressed upon. In other words, one half of the connector can be configured in a manner similar to that illustrated in U.S. patent application Ser. No. 12/328,577. Once the first panel 30 is retained in the co-edge connector 200, a second panel 120 can be mounted on the housing 200*a* by placing the second panel 120 on the support surface 206 so that traces on the second panel 120 engage and press on the contacts 211.

Because the second panel 120 can be mounted to the co-edge connector 200 in a substantially vertical direction, the space required to allow the co-edge connector 200 to couple the two panels can be substantially close to an enclosure opening 6. Of course, the enclosure distance 6 can be larger than the minimum possible distance. This embodiment, however, makes it possible for installation in an assembly with less space than would otherwise required. For example, with the connector design of FIG. 1, the minimum clearance on both sides of the connector would be the width of the panel from the edge of the connector. In contrast, it is possible for the clearance on one side to be the width of the panel less the distance the panel overlaps with the co-edge connector 200. A fastener 226 may then be used to secure the second panel 120 to the co-edge connector 200 (and also to an underlying support structure, if desired).

FIGS. 6-9 illustrate another embodiment that is similar to the embodiment depicted in FIGS. 2-5 but with the support surface 206' facing down (relative to the enclosure 5). As depicted, a second panel 120' is coupled to a housing 200*a* and secured in place via a fastener 225' that extends through the housing 200*a'* and the panel 120' and engages a mating structure 126, which may be integrated in the second panel or may be a separate structure and can include threads if the fastener 225' is so configured. The housing 200*a* includes a slot 230' with a top surface 201*a*, a bottom surface 201*b* and a rear surface 201*c* shown in broken line. As can be appreciated, the embodiment depicted in FIGS. 6-9 omits certain support structure for purposes of simplifying the disclosure and it is envisioned that the entire assembly will be supported by features not shown for purposes of clarity. In addition, aligning the terminals with the traces is somewhat of a blind operation but if alignment features are included in the co-edge connector (and or panel) then the engagement can be accomplished with a desirable degree of accuracy. The benefit of the configuration depicted in FIGS. 6-9, however, is that while allowed for close to a minimum enclosure size (depending on installation practice), the terminals 210' are facing down and thus protected from damage or contamination prior to assembly of the panel 120', thus helping to ensure a reliable connection between contact 211' and a corresponding pad on the panel 120 (not shown).

Figure 10:
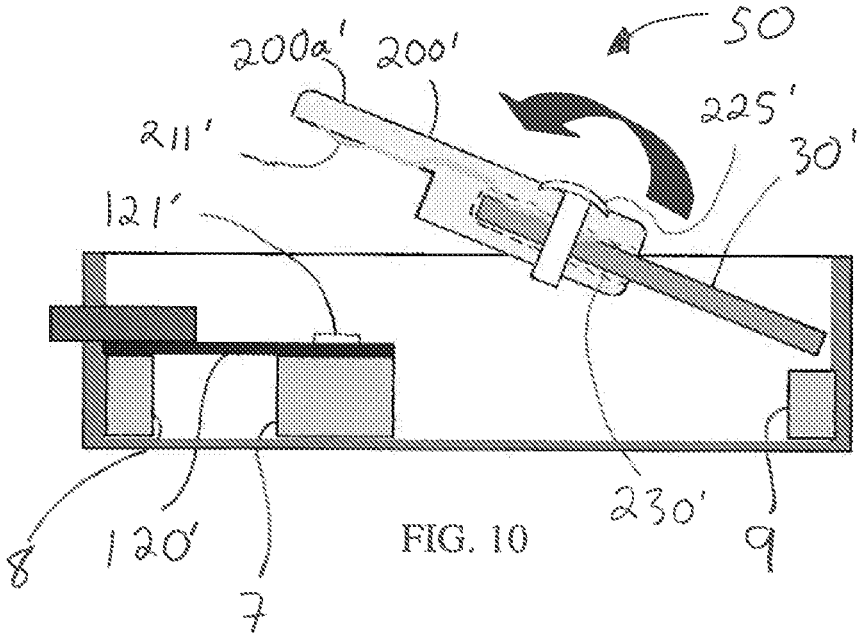
FIG. 10 illustrates an elevated side schematic view of an embodiment of a co-edge connector suitable for a particular receptacle with the co-edge connector partially assembled.
Figure 11:
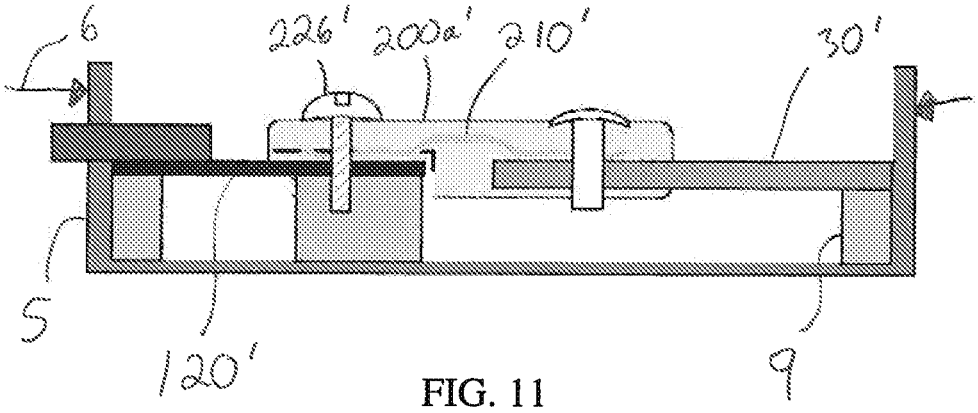
FIG. 11 illustrates an elevated side schematic view of the embodiment depicted in FIG. 10 with the co-edge connector assembled.

FIGS. 10-11 illustrate another method of coupling two panels together. A panel 120 is supported by support structure 7, 8 so that the panel 120' is in a desired location. Before mounting the connector assembly 50 into the enclosure 5, a panel 30' is inserted into a slot 230' of housing 200*a'* and the panel 30' is retained in position. The panel 30' can be retained by a fastener 225' (as shown) that is installed after the panel 30' is inserted into the slot 230' or it can be an internal locking mechanism that is part of connector 200', as discussed above. Next the assembly 50 is mounted on appropriate support structure 7 so that contact 211' is positioned on pad 121' (which is shown as a raised pad for purpose of clarity but in practice may not be raised). A fastener 226' is then used to secure the connector 200' to the panel 120'. As depicted, a threaded fastener 226' is depicted as being screwed into a support structure 7. As can be appreciated, however, a threaded member could extend out and be coupled with a nut. In addition, a rivet could also be used if desired. Furthermore, a removable clamp could also be used as long as it was configured to ensure sufficient force to cause the contact 211' to reliably engage the trace 121' on the panel. Thus, a number of variations in how the clamping force can be applied are contemplated.

Figure 12:
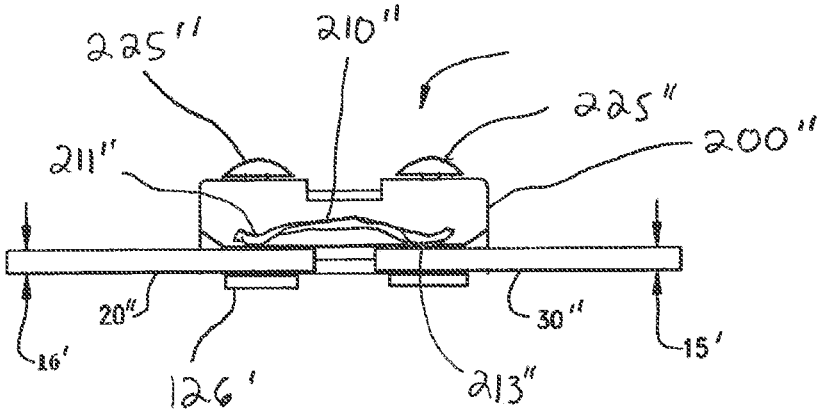
FIG. 12 illustrates an elevated side-view of another embodiment of a co-edge connector mounted on two circuit boards.

FIG. 12 illustrates an alternative embodiment with terminals of the co-edge connector exposed on both sides of the connector. This allows the panels to be coupled to the co-edge connector in the desired order. It should be noted that while the co-edge connector is depicted on as being positioned above the panels, the configuration may be orientated so that the co-edge connector is position on the side or on the bottom. To ensure desirable alignment, the fastening feature that couples the panels to the co-edge connector can be configured to a desirable degree of tolerance so that a reliable connection between the traces can be established.

Figure 13:
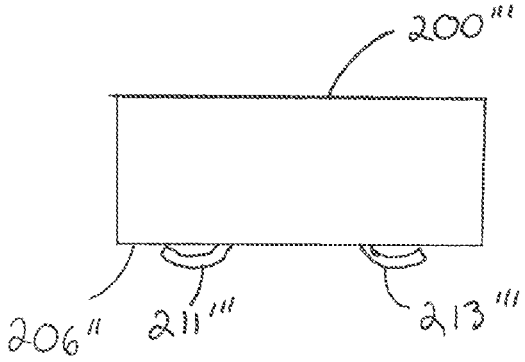
FIG. 13 illustrates an elevated side schematic view of an embodiment of a co-edge connector suitable for use in an assembly as depicted in FIG. 12 with the co-edge connector in an unassembled state.

FIG. 13 illustrates a schematic of an embodiment of a co-edge connector suitable for use with arrangement depicted in FIG. 12. As can be appreciated, the terminals extend beyond support surface 206" and when assembled could be deflected so that they were flush with the support surface 206" (thus helping to provide a secure electrical connector between terminal contacts and corresponding pads on a mating panel.

Figure 2:
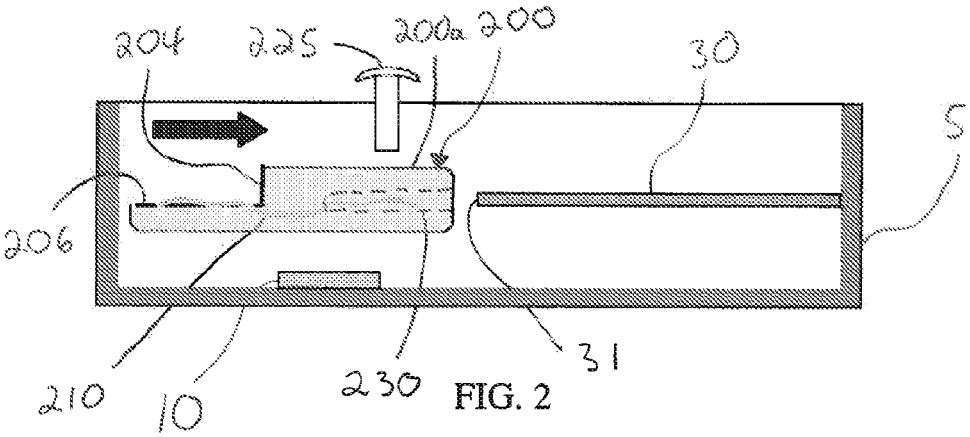
FIG. 2 illustrates an elevated side schematic view of an alternative embodiment of a co-edge connector with a notch.
Figure 3:
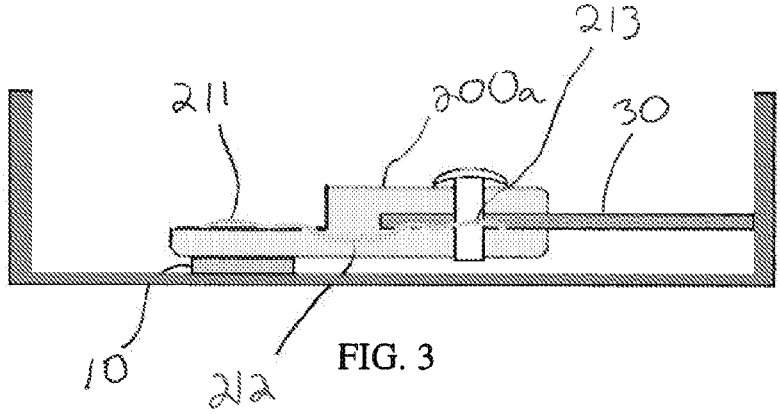
FIG. 3 illustrates an elevated side schematic view of the co-edge connector of FIG. 2 positioned in an enclosure.
Figure 4:
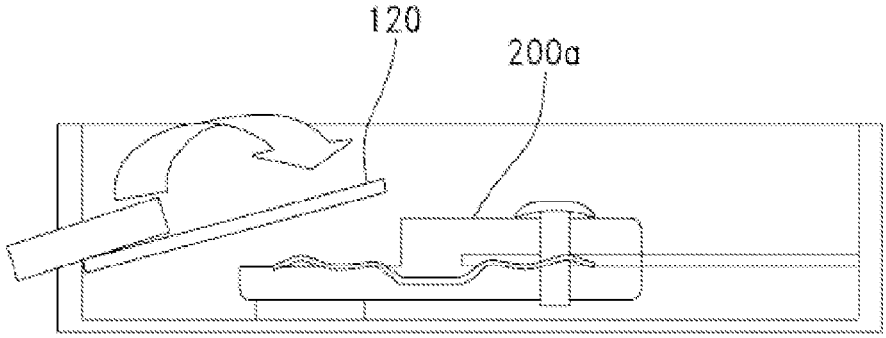
FIG. 4 illustrates an elevated side schematic view of the co-edge connector of FIG. 2 prior to a second circuit board being mounted on the co-edge connector
Figure 5:
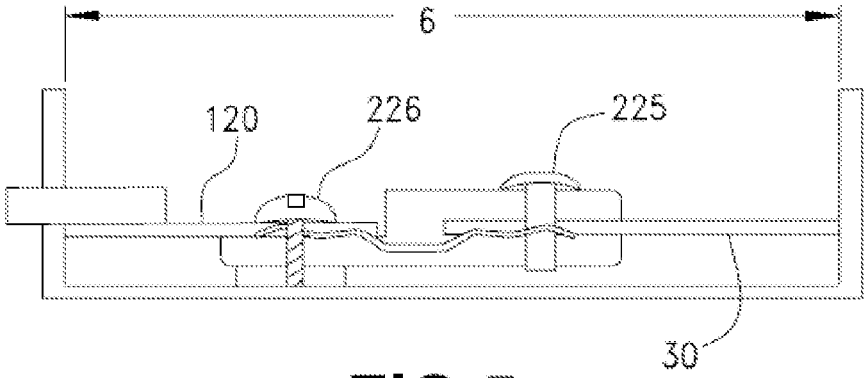
FIG. 5 illustrates an elevated side schematic view of the co-edge connector of FIG. 2 with a second circuit board mounted on the co-edge connector.
Figure 6:
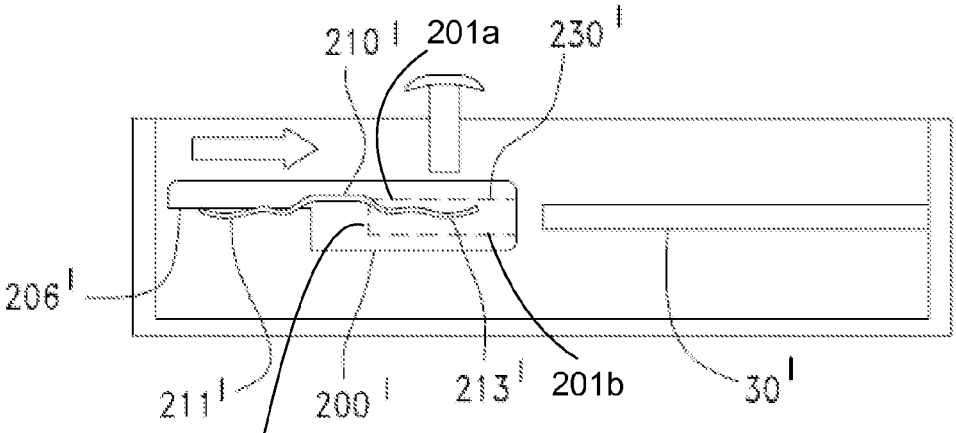
FIG. 6 illustrates an elevated side schematic view of another embodiment of a co-edge connector in an early stage of assembly.
Figure 7:
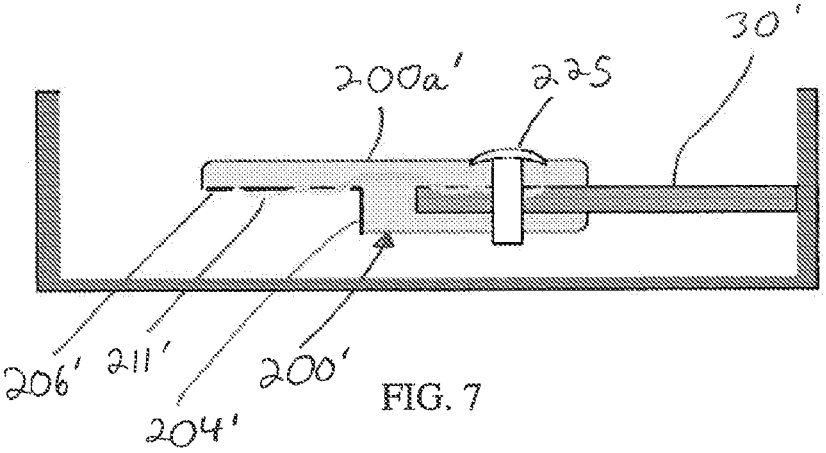
FIG. 7 illustrates an elevated side schematic view of the co-edge connector depicted in FIG. 6 with a first circuit board mounted to the co-edge connector.
Figure 8:
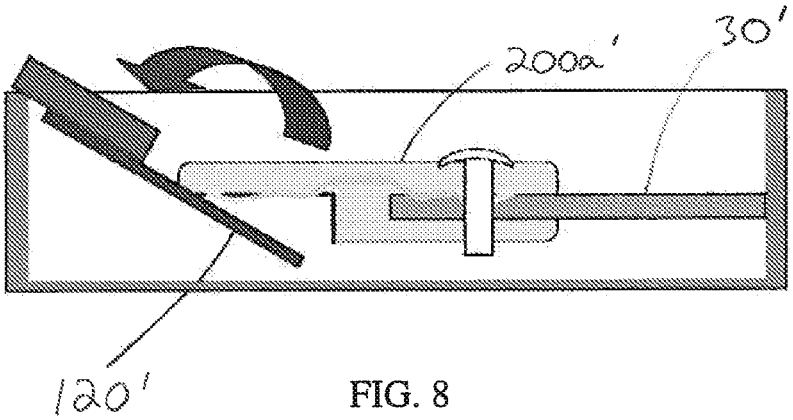
FIG. 8 illustrates an elevated side schematic view of the embodiment depicted in FIG. 7 with a second circuit board partially assembled.
Figure 9:
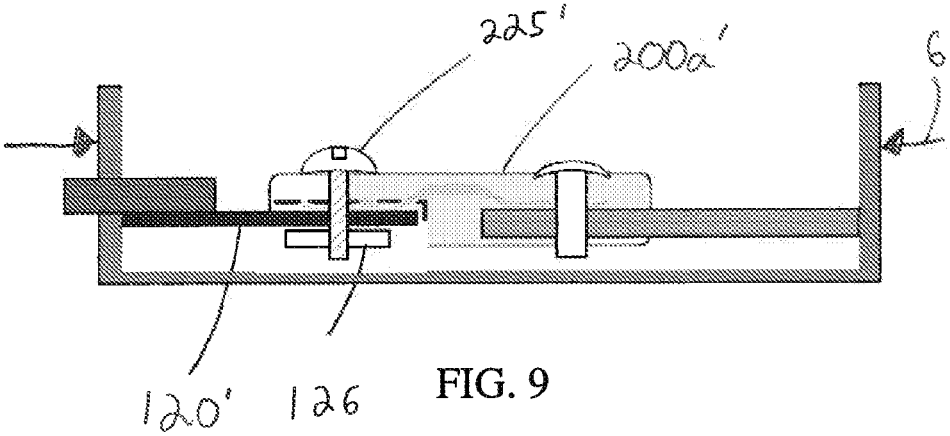
FIG. 9 illustrates an elevated side schematic view of the embodiment depicted in FIG. 8 with the second circuit board mounted to the co-edge connector.
Figure 14:
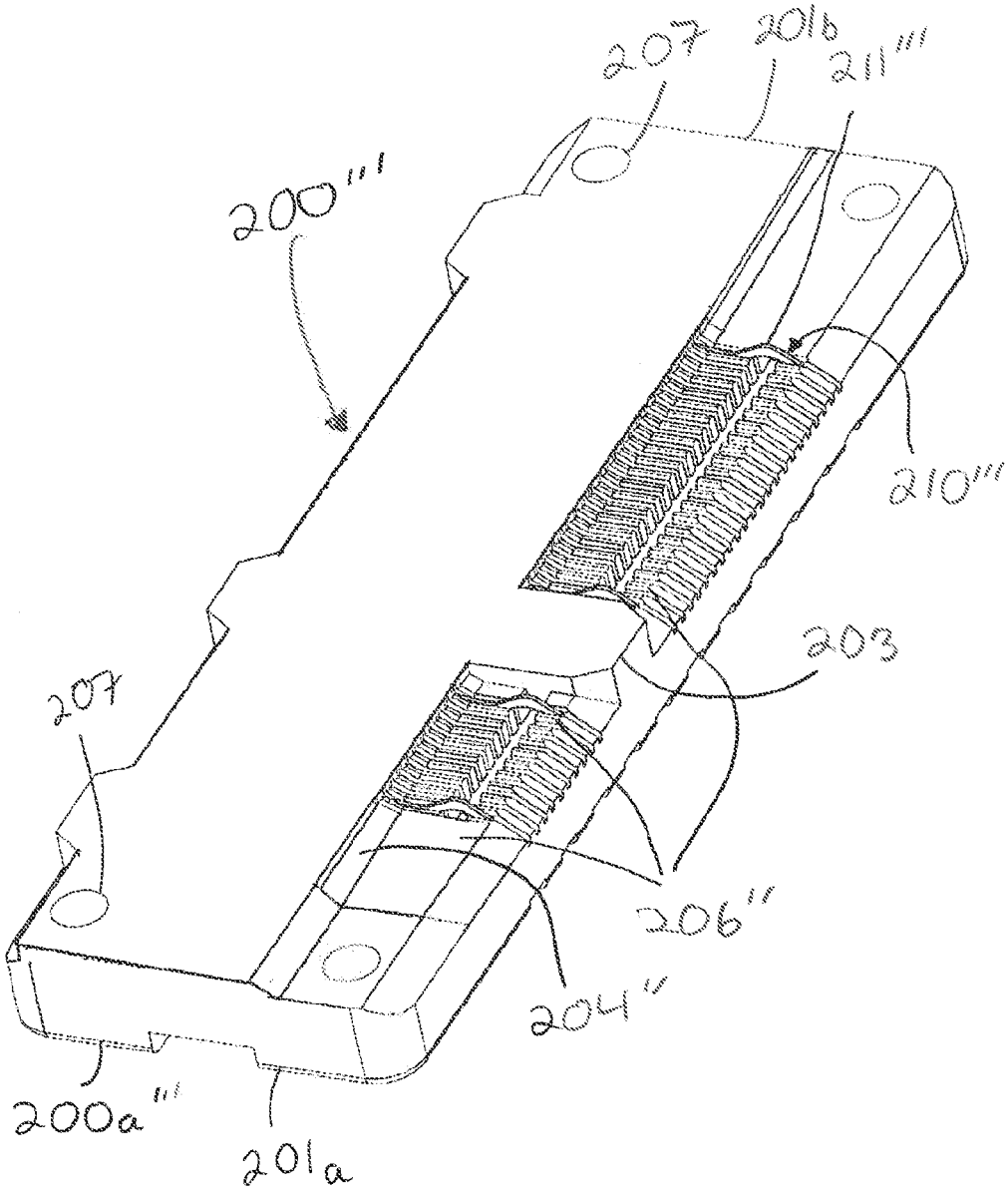
FIG. 14 illustrates a perspective view of an embodiment of a co-edge connector.

FIG. 14 illustrates a perspective view of an embodiment of co-edge connector similar to that depicted in FIG. 2. As can be appreciated, the wall 204" is angled and support surface 206" includes a portion define by a series of ribs that extend between terminals 210''' and contact 211''' extends beyond the support surface. As can be appreciated, a terminal can be positioned between each rib that makes up the support surface 206" so as to provide desirable density. Furthermore, it is expected that two adjacent terminals may provide a differential signal pair. As the use of differential signal pairs is known and is discussed in the incorporated application referenced above, no further discussion is needed herein. To help position the co-edge connector 200''', an orientation feature 203 (which as depicted is a projection) can be provided and a corresponding notch in the mating panel can be provided. To allow the respective panels to be retained to the housing 200*a'''*, a fastener aperture 207 can be provided on two ends 201*a*, 201*b* so that a fastener can secure a mating panel to the housing.

It should be noted that the fastener (if not integral to the co-edge connector) can be configured to first extend through either the co-edge connector or the panel. Thus, the orientation of the fastener, if used, can be readily varied depending on the orientation of the co-edge connector and the panel that is going to be mounted to the co-edge connector. Thus, while a number of variations exist, the ability to have a co-edge connector with at least one side including exposed terminals allows for a perpendicular engagement that would not otherwise be possible with a conventional co-edge connector that included two slots.

It should be noted that while a horizontal orientation is depicted in the Figures, some other orientation such as vertical or angled may also be used. Ease of assembly, however, will be promoted if the panel and co-edge connector are kept horizontal while being assembled, particularly if a threaded fastener is used to secure the terminals to the traces.

The present invention has been described in terms of preferred and exemplary embodiments thereof. Numerous other embodiments, modifications and variations within the scope and spirit of the disclosure will occur to persons of ordinary skill in the art.

We claim:

1. A connector, comprising:

a housing with a wall, the housing have slot on a first side of the wall, the slot defined by a top surface, a bottom surface and a rear surface and configured to allow, in operation, insertion of a mating panel into the slot in a first direction toward the wall, and the housing including a support surface extending on a second side of the wall in a second direction, the second direction being opposite the first direction, wherein the support surface is exposed; and a first and second terminal supported by the housing, each of the first and second terminals having a first contact in the slot and a second contact extending above the support surface, the slot extending around the first contact, the first and second terminals provide signal terminals.

2. The connector of claim 1, wherein the terminals provide a differential signal pair.

3. The connector of claim 1, wherein a rib is positioned between adjacent terminals and the rib helps define the support surface.

4. The connector of claim 1, wherein the wall is angled.

5. The connector of claim 1, wherein the housing includes a first and second aperture provided on opposite ends of the housing.

6. The connector of claim 1, wherein the housing is configured to receive a mating panel on the support surface, the housing configured, in operation, to allow the mating panel to be positioned on the support surface by movement in a third direction, the third direction being perpendicular to the first direction.

7. An assembly comprising:

a housing with a wall and a slot on a first side of the wall, the slot defined by a top surface, a bottom surface and a rear surface and configured to receive a panel inserted in a first direction, and the housing including a support surface extending from a second side of the wall, the second side being opposite the first side, wherein the support surface is exposed;

a first and second terminal supported by the housing, each of the first and second terminals having a first contact in the slot and a second contact extending above the support surface, the slot extending around the first contact and the first and second terminals providing signal terminals; and a panel mounted in the slot, the panel having a first and second pad mating to the first contacts of the first and second terminal, wherein the housing is configured, in operation, to allow a mating panel to be positioned on the support surface by movement in a second direction, the second direction being perpendicular to the first direction.

8. The assembly of claim 7, wherein the terminals provide a differential signal pair.

9. The assembly of claim 7, wherein a rib is positioned between adjacent terminals and the rib helps define the support surface.

10. The assembly of claim 7, wherein the wall is angled.

11. The assembly of claim 7, further comprising a fastener configured to retain the panel to the housing.

12. The assembly of claim 11, wherein the fastener is a first fastener in a first aperture on a first end of the housing, the assembly further comprising a second fastener in a second aperture on a second end of the housing.

* * * * *